US006877472B2

(12) United States Patent
Lepoutre

(10) Patent No.: US 6,877,472 B2
(45) Date of Patent: Apr. 12, 2005

(54) POROUS DUCT CONFIGURED WITH A THIN FILM

(75) Inventor: Henri Lepoutre, Roubaix Cedex (FR)

(73) Assignee: Wecosta (FR)

( * ) Notice: Subject to any disclaimer, the term of this patent is extended or adjusted under 35 U.S.C. 154(b) by 16 days.

(21) Appl. No.: 10/614,355

(22) Filed: Jul. 7, 2003

(65) Prior Publication Data

US 2004/0069261 A1 Apr. 15, 2004

(51) Int. Cl.[7] ..... F02M 35/10
(52) U.S. Cl. ..... 123/184.61; 138/141; 184/252
(58) Field of Search ..... 123/184.61, 184.21; 138/141, 145, 146, 149; 181/224, 229, 252

(56) References Cited

U.S. PATENT DOCUMENTS 3,183,941 A * 5/1965 Woodell ..... 138/141
3,205,913 A * 9/1965 Ehlers ..... 138/125
5,379,806 A 1/1995 Matthews et al. ..... 138/149
5,947,158 A * 9/1999 Gross et al. ..... 138/149

FOREIGN PATENT DOCUMENTS

| | | | |
|---|---|---|---|
| DE | 197 50 102 | 6/1999 | ..... F16L/55/033 |
| EP | 1 170 499 | 1/2002 | ..... F02M/35/12 |

* cited by examiner

*Primary Examiner*—Noah P. Kamen
(74) *Attorney, Agent, or Firm*—Renner, Kenner, Greive, Bobak, Taylor & Weber

(57) ABSTRACT

An intake duct 1 is provided, particularly for taking air in an internal combustion engine, notably the engine of an automobile. The duct includes a first wall 2 made of a porous material, wherein a film 4 is implemented which is sufficiently thin for avoiding any incidence upon the acoustical characteristics, having notably a surface mass of less than 100 grams per square meter. The film 4 is fixed onto the porous wall 2 such that at least 50% of the surface of the film facing the porous wall 2 is not fixed thereto.

8 Claims, 1 Drawing Sheet

POROUS DUCT CONFIGURED WITH A THIN FILM

BACKGROUND OF THE INVENTION

1. Field of the Invention

The present invention relates to air intake ducts. More particularly, the present invention relates to intake ducts for the combustion air of an internal combustion engine in an automobile.

2. Description of the Related Art

Air intake ducts configured with a porous wall are known according to the known prior art. The porous walls provide for better acoustic characteristics because the acoustical resonance of the air column delimited by the porous wall are largely dampened, unlike known plastic ducts with rigid and impervious walls. Indeed, pulses corresponding to the resonance frequencies within the air column may propagate to the outside by traversing the porous wall, which diminishes the intensity of the respective pressure and speed antinodes.

However, air intake ducts configured with porous walls according to the known prior art feature many disadvantages. Firstly, the porous wall is permeable to the warm air located for instance under the engine hood. The warm air arriving within the cylinders after permeating the porous wall is detrimental to the power and/or torque performance of the engine. Secondly, ducts with porous walls of the known art feature some coarseness, from which a loss of load arises by means of the ducted air rubbing against the coarse wall thereof. Finally, it is necessary to include a very wide plastic oversleeve in such air intake ducting systems in order to obtain a sufficient imperviousness when immersed in water, which is very detrimental from an acoustical and style point of view, as well as with regard to the thermal ageing of the plastic material. Alternatively, it is imperative to soak the fibrous material forming the porous wall with a fluoride-based resin, which is an expensive and complicated solution from an industrial point of view and does not provide a uniform imperviousness over all the areas of the duct wall.

The present invention overcomes the disadvantages of ducts configured with a porous wall according to the known prior art by providing an air intake duct configured with acoustical characteristics as good as those of the ducts of the known prior art, but which is impervious to any external fluid (warm air or water), and features a minimal loss of load along the duct and is less expensive than the impervious acoustical ducts of the known prior art.

BRIEF SUMMARY OF THE INVENTION

According to the present invention, there is provided an intake duct, particularly for taking air in an internal combustion engine, particularly that of an automobile, which includes a first wall made of a porous material, wherein a film is implemented, which is sufficiently thin for avoiding any incidence upon acoustical characteristics and has a surface mass of less than 100 grams per square meter, and the film is fixed to the porous wall such that at least a part, in particular at least 50%, of the film surface facing the porous wall is not fixed thereto.

Having regard to the fact that large portions of the surface of the film are not fixed onto the porous wall, the film does therefore not completely lay against the porous wall and may thus move under the influence of aerial pulses within the duct. The film is a minimal obstructions to the propagation of waves pulsed through the porous wall by way of its lightness and, especially, its capacity to move. In effect, the aim is to strictly limit the role of this film to that of a fluid barrier.

According to a particularly economical and simple embodiment of the present invention, the film is fixed to the porous wall according to a pattern of points and/or lines. For instance, the film may be fixed to the wall at a plurality of points configured with a small diameter and arranged as a pattern, for example a square.

According to another example, the porous wall and film are fixed to one another along the lines configured as a pattern, for example a checked pattern.

According to a particularly advantageous embodiment the present invention and, particularly in the case where the duct shall be used in under-pressure, i.e. the case in which pressure within the duct is less than outside the duct, as is the case an engine intake duct, the film is located inside the duct formed by the porous wall. Indeed, in the opposite case, the film would be continually laid against the wall and thus form an obstructions to the propagation of waves because it would not be free. Having regard to the locating of the film made of a plastic material within the porous wall, the film is therefore protected, as is its physical integrity and, consequently, its imperviousness.

According to a particularly advantageous embodiment of the present invention, which is economical and simple to manufacture, the film is fixed to the porous wall by means of welding or gluing and, preferably, by means of ultrasonic welding.

WRITTEN DESCRIPTION OF THE BEST MODE FOR CARRYING OUT THE INVENTION

FIG. 1

Figure 1:
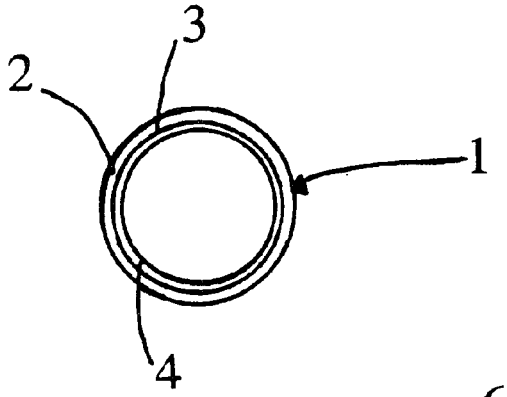
FIG. 1 shows a longitudinal cross-section of a duct according to the present invention.
Figure 2A:
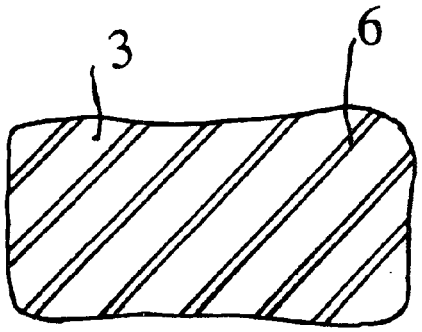
FIGS. 2A, 2B and 2C respectively illustrate examples of fixing or gluing or welding patterns for fixing the porous wall to the film of plastic material.
Figure 2B:
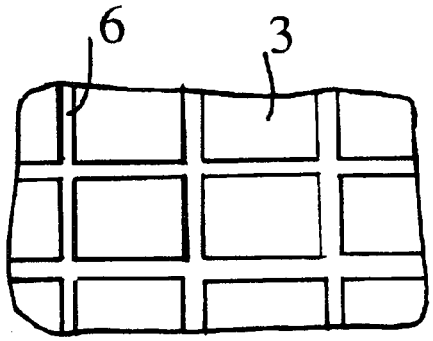
Figure 2C:
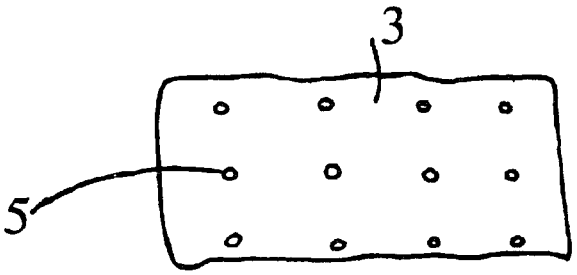

In FIG. 1, the air intake duct 1 of an internal combustion engine provides air to be combusted within the internal combustion engine. The duct is shown in the figure with a tubular shape and comprises a first tubular wall 2 made of a porous material, i.e. having openings through which fluids may pass, wherein the material maybe any of the following: open-cell foam, woven fabric or nonwoven fabric.

The thickness of the porous wall generally lies between one millimeter and three millimeters. The diameter of the porous wall generally lies between forty millimeters and seventy millimeters. A film 4 made of a plastic material is fixed to the internal surface 3 of the tubular wall 2, wherein the material is notably in polyethylene, polypropylene, polyamide, polyester, or another. The film made of plastic material is for instance configured with a thickness of 30 im.

Such a thickness is sufficiently thin for avoiding any incidence of the film of plastic material upon the accoustical characteristics of the combination of the porous wall with the film of plastic material, i.e. the surface mass is sufficiently low. The porous wall is generally made of a fibrous material, preferably a nonwoven fabric configured with synthetic or natural fibres.

The film of plastic material 4 is fixed inside against the internal surface of the porous wall 2. The film 4 may also be fixed outside the porous wall, in the case of a duct to be used in over-pressure or equilibrated pressure.

FIG. 2

In the preferred embodiment of the present invention, the fixing is performed by way of thermal welding following a network 5 of welding points, wherein each such point has for instance a diameter of 3 millimeters and the points are configured as a pattern of squares of 10 millimeters. In this embodiment, more than 90% of the internal surface between both walls are free of any relative movement. Consequently, acoustical resonance may be dampened by the porous wall as if there were no film of plastic material therein. Moreover, the film of plastic material prevents load losses linked to air rubbing against the fibrous material on the one hand and ensures imperviousness relative to the external warm air, which would otherwise be taken in by the engine. An engine with a better performance is therefore obtained.

According to alternative embodiments of the present invention, fixings by means of welding or gluing between the two walls may follow patterns configured with lines 6 and, preferably, following a rectangular checked pattern configured with squares or lozenges. Any other shape or pattern may be used so long as a sufficient surface of the interface between the two walls remains free of movement. Preferably, at least 50% of the interface surface should remain free of movement.

What is claimed is:

1. An intake duct for taking air in an internal combustion engine, including a first wall made of a porous material, wherein a film is implemented which is sufficiently thin for avoiding any incidence upon the acoustical characteristics, having a surface mass of generally less than 100 grams per square meter; and wherein at least fifty percent of said film surface is not fixed to said porous wall.

2. An intake duct according to claim 1, wherein said film is fixed to said porous wall at a plurality of points configured with a small diameter and forming a pattern, which is generally square.

3. An intake duct according to claim 1, wherein said film and said porous wall are fixed to one another along lines forming a pattern, which is checked.

4. An intake duct according to claim 1, wherein said film is located inside said porous wall.

5. An intake duct according to claim 1, wherein the fixing of said film to said porous wall is performed by way of ultrasonic welding.

6. An intake duct according to claim 1, wherein said film is made of polyethylene, polypropylene, polyamide, polyester or another plastic material.

7. An intake duct according to claim 1, wherein the fixing of said films to said porous wall is performed by way of gluing.

8. An intake duct for taking air in an internal combustion engine, including a first wall made of a porous material, wherein a film is implemented which is sufficiently thin for avoiding any incidence upon the acoustical characteristics, having a surface mass of generally less than 100 grams per square meter; and wherein said film is fixed to said porous wall following a pattern of points and/or lines such that at least part of the surface of said film facing said porous wall is not fixed thereto.

* * * * *